US005420906A

United States Patent [19]

Smit et al.

[11] Patent Number: 5,420,906

[45] Date of Patent: May 30, 1995

[54] X-RAY TUBE WITH IMPROVED TEMPERATURE CONTROL

[75] Inventors: Hubert H. A. Smit, Almelo; Theodorus J. J. M. Jenneskens; Jan C. Gijsbers, both of Eindhoven, all of Netherlands

[73] Assignee: U.S. Philips Corporation, New York, N.Y.

[21] Appl. No.: 222,557

[22] Filed: Apr. 4, 1994

Related U.S. Application Data

[63] Continuation of Ser. No. 8,112, Jan. 25, 1993.

[30] Foreign Application Priority Data

Jan. 27, 1992 [EP] European Pat. Off. ..... 92200207

[51] Int. Cl.[6] ..... H01J 35/10

[52] U.S. Cl. ..... 378/141; 378/143

[58] Field of Search ..... 378/141, 142, 143

[56] References Cited

U.S. PATENT DOCUMENTS

| | | | |
|---|---|---|---|
| 4,731,804 | 3/1988 | Jenkins | 378/141 |
| 4,969,173 | 11/1990 | Valkonet | 378/143 |
| 5,204,891 | 4/1993 | Woodruff et al. | 378/143 |

*Primary Examiner*—Craig E. Church
*Attorney, Agent, or Firm*—Anne E. Barschall

[57] ABSTRACT

In order to enhance the dissipation of heat, a metal structure is provided between an anode target layer and a support for the anode target layer in an X-ray tube. In the case of a target transmission tube, notably the dissipation of heat to the window wall is enhanced, whereas in the case of an anode target layer provided on a suitably thermally conductive anode body, the dissipation of heat to said body is enhanced.

8 Claims, 1 Drawing Sheet

X-RAY TUBE WITH IMPROVED TEMPERATURE CONTROL

Figure 1:
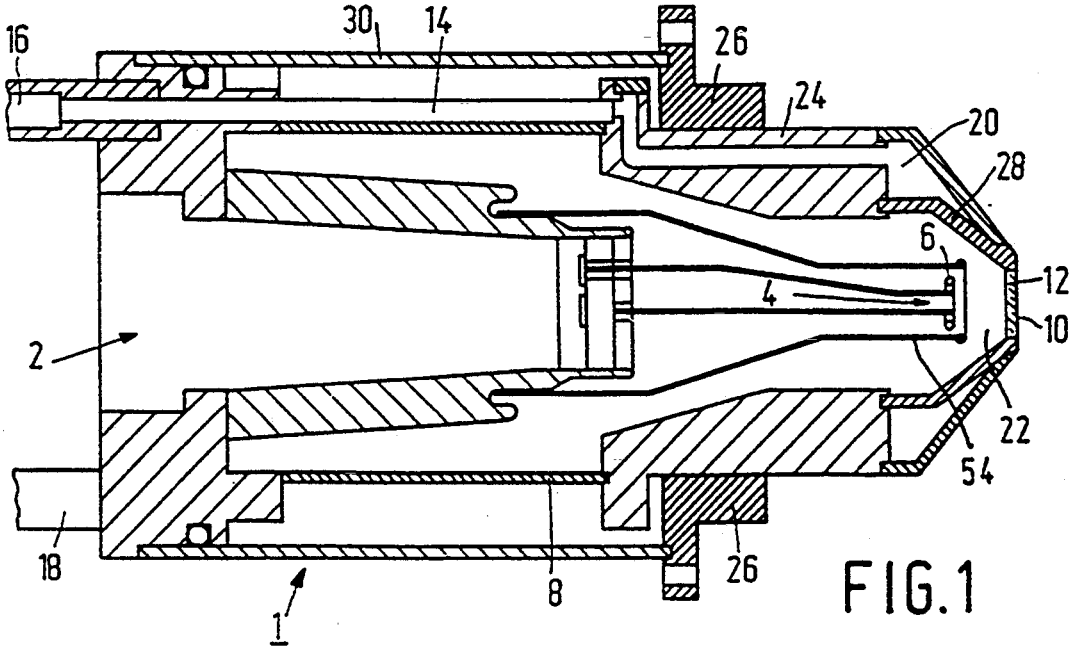

This is a continuation of application Ser. No. 08/008,112, filed Jan. 25, 1993.

The invention relates to an X-ray tube, comprising a cathode for generating an electron beam and an anode, having a comparatively thin anode target layer, for generating X-rays in response to the impingement of the electron beam, and also comprising an X-ray exit window.

An X-ray tube of this kind is known as a target transmission tube from U.S. Pat. No. 4,969,173. An X-ray tube described therein comprises a radiation exit window which is made of, for example beryllium and an inner side of which is provided with a thin layer of metal which acts as the anode target layer. In the anode target layer notably the X-rays are generated, which X-rays emanate directly via the exit window in this case.

A thin anode target layer of this kind may also be provided on an anode support of a suitably thermally conductive material mounted in an X-ray tube. In the case of such thin anode target layers, the degree of dissipation of the heat generated by the incident electron beam has a strong effect on the service life of the tube. This problem is significant in target transmission tubes because of the comparatively poor thermal conductivity of the thin anode target layer itself as well as of the comparatively thin beryllium exit window. In the case of anode target layers provided on a metal anode support the problem of locally excessive temperatures may arise because the transition between the anode target layer and the anode support constitutes a heat barrier.

It is inter alia an object of the invention to mitigate these drawbacks; to achieve this, an X-ray tube of the kind set forth in accordance with the invention is characterized in that the anode target plate comprises means for enhancing the dissipation of heat.

Because the anode target layer itself is provided with means for enhancing the dissipation of heat, the temperature of this layer as a whole, and notably at the area of the electron target spot, will become less high, so that the layer will be less readily damaged and the service life of the tube is prolonged.

In a preferred embodiment, the means for enhancing the dissipation of heat constitute a metal structure which is provided in or against the anode target plate and which is thermally conductively connected to a wall portion of the X-ray tube or to a suitably thermally conductive anode support. The metal structure is notably a metal gauze which does not have a disturbing effect on the X-ray emission and provides adequate dissipation of heat. When the anode target layer is provided on a window plate, such a gauze structure may also provide a substantial reinforcement of the window, so that the window becomes less vulnerable or can be constructed to be thinner, resulting in an increased transmission.

In a preferred embodiment, a metal layer provided near an electron target face forms part of the means for enhancing the dissipation of heat. The metal layer is provided notably within a substantially annular electron target spot, so that the spot exhibits suitable dissipation of heat to both radial sides and a central part of the window as well as an irradiated part of the window will become considerably less hot.

In a further preferred embodiment, an anti-diffusion layer is provided between the anode target layer and a layer supporting the anode target layer. Using such a layer, a reduction of the thermal conduction between the two layers can be prevented, for example due to the appearance of intermetallic compounds. Such an anti-diffusion layer can also reduce other adverse interactions between the layers; for example, the loss of vacuum-tightness of the window can thus also be prevented. An anti-diffusion layer of this kind is provided notably between a window plate of beryllium and an anode target plate which is provided thereon and which consists of, for example rhodium scandium or another known anode target plate material.

Figure 2:
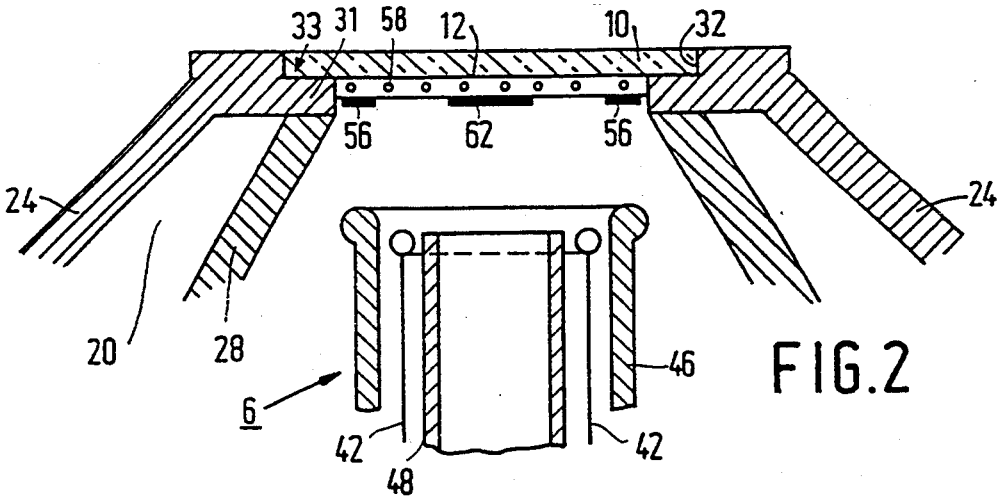
Figure 3:
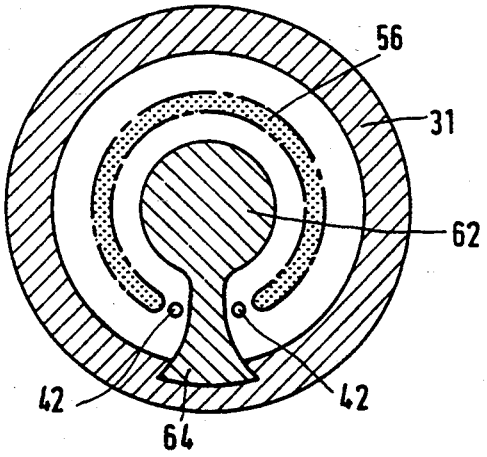

Some preferred embodiments in accordance with the invention will be described in detail hereinafter with reference to the drawing. Therein:

FIG. 1 shows an X-ray tube comprising a target transmission anode and an annular electron target spot, FIG. 2 shows an embodiment of an anode target layer and a metal structure for enhancing the dissipation of heat in such a tube, and FIG. 3 shows an anode window with a locally deposited metal layer acting as a heat dissipation means.

An X-ray tube as shown in FIG. 1 comprises an envelope 1 with a conical ceramic base 2, a cathode 4 with an emissive element in the form of a filament 6, a cylindrical wall 8 and an exit window 10. An anode 12 is provided in the form of an anode target layer on an inner side of the exit window. The anode consists of, for example chromium, rhodium, scandium or another anode material. The thickness of the layer is adapted to the desired radiation, to the radiation absorption properties of the material, notably to the electron absorption thereof, and to the desired high voltage for the tube, and amounts to, for example a few $\mu$m.

In the envelope there is provided a cooling duct 14 with an inlet 16, an outlet 18 and a flow duct 20 which encloses the exit window.

A high-voltage connector can be inserted into the base 2. A high-voltage connector of this kind is connected to a high-voltage cable, to supply leads for the filament and to supply leads for any further electrodes to be arranged in an anode-cathode space 22. Around the envelope there is provided a mounting sleeve 24 with a mounting flange 26 and an additional radiation shield 28 which also bounds the flow duct 20. Around the tube there is also arranged a thin-walled mounting sleeve 30 in which the cooling ducts are accommodated and which also has a temperature-equalizing effect.

FIG. 2 shows the window-anode construction at an increased scale. The window 10 is provided, for example by local diffusion at the area of a mounting edge 33, in a window support 31 in the envelope. When it is ensured that the window support 31 adjoins the flow duct 20 and is in suitable thermal contact with the envelope 24 and the shield 28, suitable dissipation of heat from the edge of the window is ensured. A comparatively thick construction of the elements 24 and 28 benefits the dissipation of heat as well as the absorption of scattered radiation.

On an inner side of the window 10 there is provided the anode 12, for example in the form of a vapour-deposited thin anode target layer. Besides vapour-deposition, sputtering or electroplating are also suitable techniques for the deposition of the anode layer. The anode customarily operates substantially at ground potential, so that no problems will be encountered as regards the electrical insulation of the comparatively thin beryllium window 10.

In the present embodiment, the electron-emissive element 6 is arranged in the cathode-anode space at a comparatively small distance from the anode. The emitter is shaped as a loop-shaped filament 40 with input and output leads 42. The filament is preferably freely suspended. Around the emitter there is arranged a sleeve-shaped electrode 46 and an electrode sleeve 48 is arranged within the filament 40. In addition to the diameter of the filament loop, a transverse dimension of a ring focus 56 to be formed can thus be varied by varying either potentials of the electrode sleeves or by varying the height position of at least one of the sleeves 46 or 48. The ring focus can be focused on the anode layer to a greater or lesser extent by optimizing the positioning and potentials carried by the sleeves.

Between the beryllium window 10 and the anode target layer 12 there is provided a gauze structure 58. Such a metal gauze of silver or gold has a pitch and a wire thickness such that the X-ray focus, being the object of a subsequent radiation optical system, is not adversely affected thereby. Such a gauze structure may also be provided on an outer side of the window and may constitute, for example a honeycomb structure of silicon carbide of another suitably thermally conductive and comparatively strong material.

FIG. 3 shows a preferred embodiment of an exit window of an exit window target transmission tube comprising a metal heat dissipation construction 62 in the form of a metal disc 62, arranged within an annular electron target spot 56, and a radial dissipation conductor 64 constituting a connection between the disc 62 and a tube wall portion 33. In this tube the focus ring has a fixed diameter, so that the metal layer 62 can be provided so as to be adjacent thereto.

We claim:

1. An X-ray tube, comprising:

(a) a cathode for generating an electron beam; and (b) an anode having a target layer for generating X-rays in response to the electron beam and a gauze structure adjacent the target layer for dissipating heat from the target layer.

2. The X-ray tube of claim 1, wherein the gauze structure is metallic and substantially transparent to the X-rays.

3. The X-ray tube of claim 1, wherein the gauze structure is against the target layer.

4. The X-ray tube of claim 1, wherein the exit window is beryllium; and the gauze structure is made of silver or gold and has a pitch and a wire thickness such that the X-ray focus is not adversely affected thereby.

5. The X-ray tube of claim 1, further comprising an X-ray exit window aligned with the anode such that X-rays generated by the anode pass through the exit window.

6. The X-ray tube of claim 5, wherein the anode is located on the exit window.

7. The X-ray tube of claim 1 wherein the anode is a layer adjacent an exit window of the tube; and the gauze structure is on an outer side of the window.

8. The X-ray tube of claim 7 wherein the gauze structure is a honeycomb of silicon carbide.

* * * * *